US005289833A

United States Patent [19]

McDonald

[11] Patent Number: 5,289,833

[45] Date of Patent: Mar. 1, 1994

[54] MULTI-TOOTHED DISPENSER, COMB APPLICATOR AND BOTTLE

[76] Inventor: Charles E. McDonald, 6359 S. Rhodes, Chicago, Ill. 60637

[21] Appl. No.: 853,783

[22] Filed: Mar. 19, 1992

[51] Int. Cl.[5] ..... A45D 24/22

[52] U.S. Cl. ..... 132/112; 132/113; 132/114; 132/200; 132/208

[58] Field of Search ..... 132/112, 113, 114, 115, 132/116, 208, 200

[56] References Cited

U.S. PATENT DOCUMENTS

| | | | |
|---|---|---|---|
| 1,322,639 | 11/1919 | Snider et al. . | |
| 1,451,260 | 4/1923 | Holland . | |
| 1,570,013 | 1/1926 | Smith . | |
| 2,108,184 | 2/1938 | Wallenius | 132/116 |
| 2,122,715 | 7/1938 | Forte | 132/116 |
| 2,299,295 | 10/1942 | Battle | 132/112 |
| 2,376,065 | 5/1943 | Kuszyk | 132/13 |
| 2,381,048 | 8/1944 | Habostad | 132/13 |
| 2,642,070 | 6/1953 | Lubin | 132/13 |
| 2,956,570 | 10/1960 | Stanford | 132/116 |
| 3,059,652 | 11/1962 | Thomas | 132/112 |
| 3,101,086 | 8/1963 | Di Vito | 132/114 |
| 3,368,569 | 2/1968 | Lawrence | 132/116 |
| 3,424,176 | 11/1966 | Hale | 132/112 |
| 3,429,642 | 2/1969 | Underwood | 132/116 |
| 3,457,928 | 7/1969 | Kurshenoff | 132/113 |
| 3,520,311 | 7/1970 | Iesersek et al. | 132/116 |
| 3,961,635 | 6/1976 | Wiya | 132/113 |
| 4,294,270 | 10/1981 | Cochran | 132/112 |
| 4,399,827 | 8/1983 | Fuhs | 132/112 |
| 4,592,376 | 6/1986 | Sigmund et al. | 132/112 |
| 4,605,062 | 8/1986 | Nolin | 132/112 |
| 4,813,439 | 3/1989 | Morgan | 132/116 |
| 4,859,105 | 8/1989 | Davis | 401/286 |
| 5,024,243 | 6/1991 | Snyder | 132/112 |

FOREIGN PATENT DOCUMENTS

| | | | |
|---|---|---|---|
| 3520255 | 12/1985 | Fed. Rep. of Germany | 132/112 |
| 2255869 | 7/1975 | France | 132/113 |

*Primary Examiner*—Gene Mancene
*Assistant Examiner*—Frank A. LaViola
*Attorney, Agent, or Firm*—Patula & Associates

[57] ABSTRACT

A device for dispensing and applying chemicals onto hair or other multi-fiber composition, consisting of a deformable container, a comb having a hollow spine in fluid communication with the deformable container, and a separator with a dispenser in fluid communication with the hollow spine of the comb.

18 Claims, 2 Drawing Sheets

MULTI-TOOTHED DISPENSER, COMB APPLICATOR AND BOTTLE

This invention teaches an improved device for applying chemicals to hair.

BACKGROUND OF THE INVENTION

It has always been a challenge for the professional or home hair stylist to apply chemicals, such as hair dye or perm solution to hair quickly, easily, safely and cleanly. Most methods of applying such chemicals require complicated or sophisticated equipment, and are slow, cumbersome and create a messy work environment. The present invention offers the ideal solution to all of these problems, as it is inexpensive to manufacture, both quick and simple to use, and helps keep the work environment clean. Because the invention unites the hair separator, comb and chemical dispenser into one unit, the user can quickly and easily apply chemicals to the hair, and save energy and time because he or she does not have to constantly put down and pick up the separate components that he or she would otherwise. Combining the separate elements into one unit also increases safety in the work environment, by reducing the possibility that harmful chemicals will be spilled on the operator or the operator's client.

U.S. Pat. No. 4,605,026 to Nolin shows a comb for dispensing treatment solution to hair, but differs from the present invention because the solution is dispensed through the teeth of the comb, whereas the present invention dispenses the solution from the tip of the hair separator.

U.S. Pat. No. 4,294,270 to Cochran shows a hair treating fluid applicator, but differs from the present invention because the solution is dispensed through the tips of the teeth of the comb, whereas the present invention dispenses the solution from the tip of the hair separator. Moreover, Cochran shows a special applicator disposed on the comb at a right angle thereto, which the present invention renders unnecessary.

U.S. Pat. No. 3,424,176 to Hale shows a hair dying apparatus, but is distinguishable from the present invention because Hale does not have a hair separator as does the present invention. Further, the present invention is totally contained in one unit, unlike Hale, which separates into two.

U.S. Pat. No. 3,368,569 to Lawrence shows a hair grooming device, but differs from the present invention in that it relies on a complicated valve system to deliver the solution to the hair, and further differs from the present invention because the solution is dispensed at the base of the teeth of the comb, rather than the tip of the separator as does the present invention.

U.S. Pat. No. 3,101,086 to Di Vito shows a combined dispenser and comb, but differs from the present invention because Di Vito dispenses the hair solution through the tips of the teeth of the comb, whereas the present invention dispenses the hair solution through the tip of the hair separator.

U.S. Pat. No. 3,059,652 to Thomas shows a liquid applicator, but differs from the present invention because Thomas dispenses the hair solution through the base of the teeth of the comb, whereas the present invention dispenses the hair solution through the tip of the hair separator.

U.S. Pat. No. 2,376,065 to Kuszyk shows a comb, but differs from the present invention because Kuszyk dispenses the hair solution at the tips of the teeth of the comb, whereas the present invention dispenses the hair solution through the tip of the hair separator.

U.S. Pat. No. 1,451,260 to Holland shows a comb, but differs from the present invention because Holland dispenses the hair solution at the tips of the teeth of the comb, whereas the present invention dispenses the hair solution through the tip of the hair separator.

BRIEF SUMMARY OF THE INVENTION

A device for dispensing and applying chemicals onto hair or other multi-fiber composition, consisting of a deformable container, a comb having a hollow spine in fluid communication with the deformable container, and a separator with a dispenser in fluid communication with the hollow spine of the comb.

It is the principle object of this invention to provide a means for improving the manner in which hair chemicals are applied to hair.

It is a further object of this invention to provide a quicker and more efficient method for an operator to apply hair chemicals to hair.

It is also an object of this invention to provide a cleaner method of applying chemicals to hair.

It is an additional object of this invention to provide a less expensive way for an operator to apply hair chemicals to hair.

It is another object of this invention to provide a safer way to apply chemicals to hair.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DESCRIPTION OF THE PREFERRED EMBODIMENT

Figure 1:
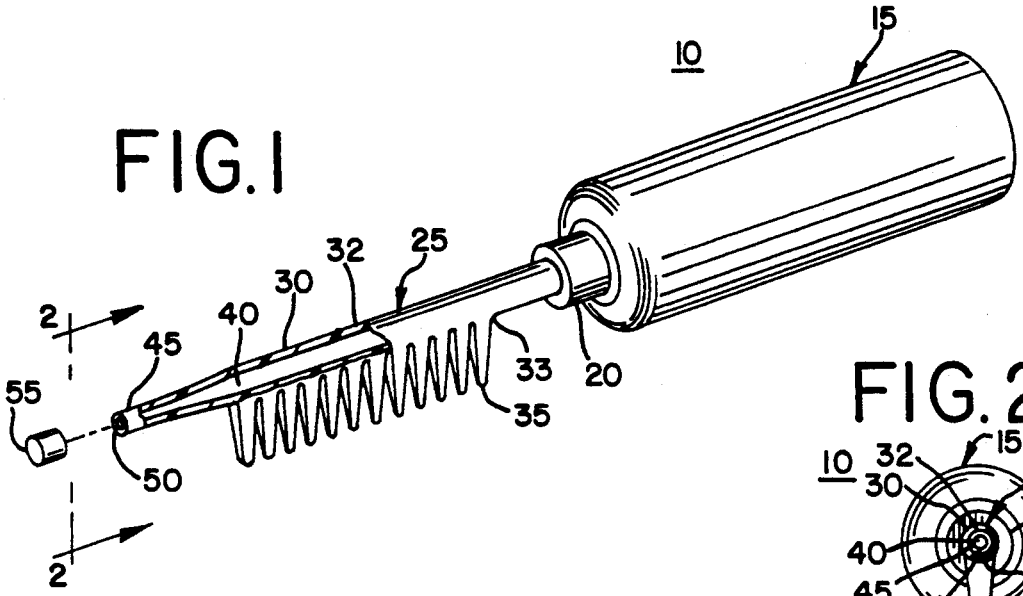
FIG. 1 is a perspective view of the preferred embodiment of the present invention.

While the invention is susceptible of embodiment in many different forms there is shown in the drawings and will be described herein in detail, preferred and alternate embodiments of the invention. It should be understood, however, that the present disclosure is to be considered an exemplification of the principles of the invention and is not intended to limit the spirit and scope of the invention and/or claims of the embodiments illustrated.

Referring now to the drawings, FIG. 1 shows the preferred embodiment of the present invention 10 consisting of deformable container or bottle 15, connected to comb 25 at connector 20 and therefore in fluid communication with comb 25. Deformable container 15 is preferably made of plastic, but can be made of any other material that can be easily squeezed by an operator. Likewise, comb 25 is also preferably made of plastic, but could be made of another rigid material such as metal or hard rubber. Comb 25 has a first end 27 and a second end 28, and also has a comb spine 30 having top of spine 32 and bottom of spine 33, with teeth 35 attached to bottom of spine 33. Attached to comb 25 is hair separator 45 having fluid dispenser 50. Comb spine 30 has internal comb cavity 40 so that fluid dispenser 50 is in fluid communication with deformable container 15 via internal comb cavity 40. Cap 55 snugly fits over fluid dispenser 50 to prevent any fluids from leaking from the invention 10 when it is not in use.

Figure 2:
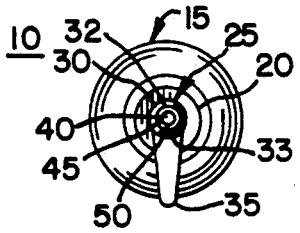
FIG. 2 is a front axial view of the preferred embodiment of the invention of FIG. 1.

FIG. 2 is an end axial view of the present invention 10, showing deformable bottle 15, connector 20, comb 25, comb spine 30, top of spine 32, bottom of spine 33, teeth 35, internal comb cavity 40, separator 45, and fluid dispenser 50.

Figure 3:
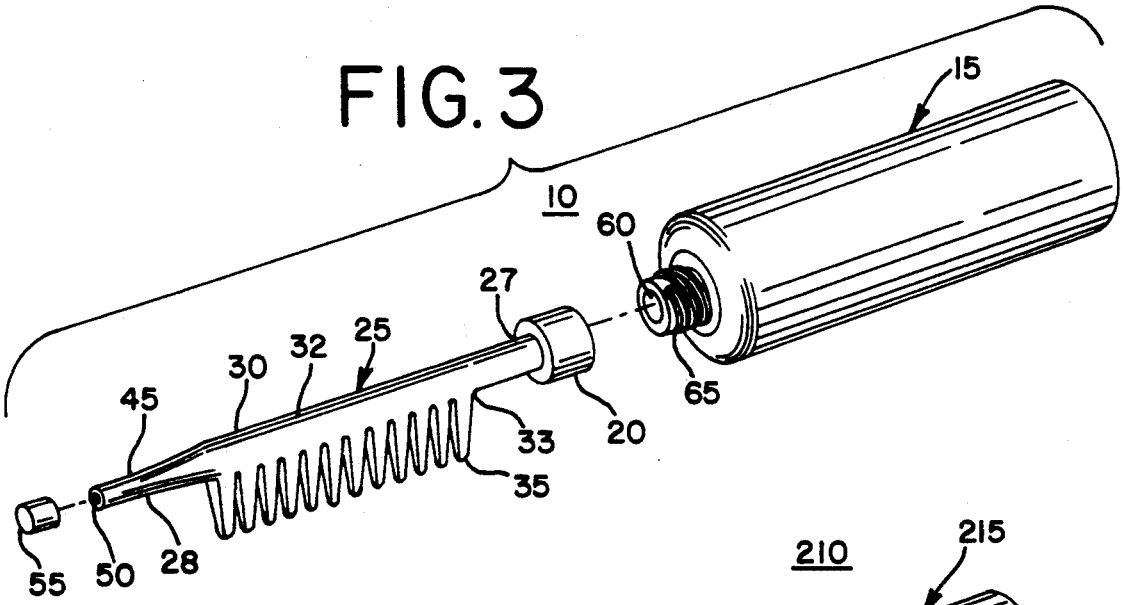
FIG. 3 is an exploded perspective view of the preferred embodiment of the invention of FIG. 1.

FIG. 3 is an exploded view of the preferred embodiment of the present invention 10. FIG. 3 shows deformable container 15, having threaded opening 65. Comb 25 having first end 27 and second end 28 attaches to deformable container 15 at connector 20 having threads (not shown) which engage threaded opening 65. Connector 20 could be made in standard sizes to fit a variety of commercially available containers having corresponding thread sizes. Comb 25 could be attached to deformable container 15 by any other method, such as where connector 20 is of a cork or stopper configuration which is forced into inside surface 60, frictionally engaging comb 25 via the inside surface 60 of threaded opening 65.

FIG. 3 further shows spine 30 having top of spine 32 and bottom of spine 33, comb spine 30 further having disposed thereon teeth 35. Extending off comb 25 is separator 45, having fluid dispenser 50, which can be covered by cap 55.

Figure 4:
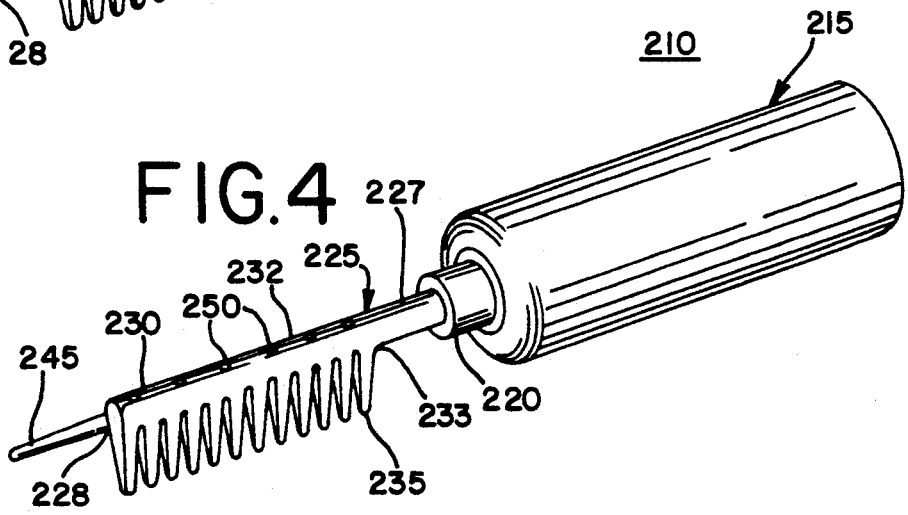
FIG. 4 is a perspective view of an alternate embodiment of the present invention.

FIG. 4 shows an alternate embodiment 210 of the present invention which is substantially the same as the invention 10 described in FIGS. 1, 2 and 3. Alternate embodiment 210 consists of deformable container 215, connected to comb 225 at connector 220. Comb 225 has first end 227 and second end 228, and a comb spine 230 having top of spine 232 and bottom of spine 233, with teeth 235 attached thereto. Attached to comb 225 is hair separator 245. Comb spine 230 has an internal cavity (not shown) of substantially the same configuration as the internal comb cavity 40 of the preferred embodiment 10 which is in fluid communication with deformable bottle 215. Disposed along the comb spine 230 are a number of dispensing holes 250 which are in fluid communication with the internal comb cavity (not shown).

Figure 5:
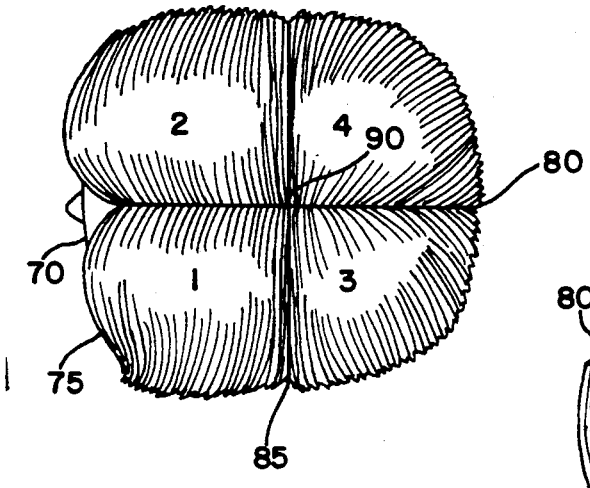
FIG. 5 is a top plan view of a human head with the hair separated into sections.

FIG. 5 shows a human head 70 with hair 75. Hair 75 is divided by the operator 105 into four roughly equal sections 1, 2, 3, and 4 by first section line 80 and second section line 85, having intersection point 90. Human head 70 is likely to be the head of a person other than the operator 105, but could also be the head of the operator 105.

Figure 6:
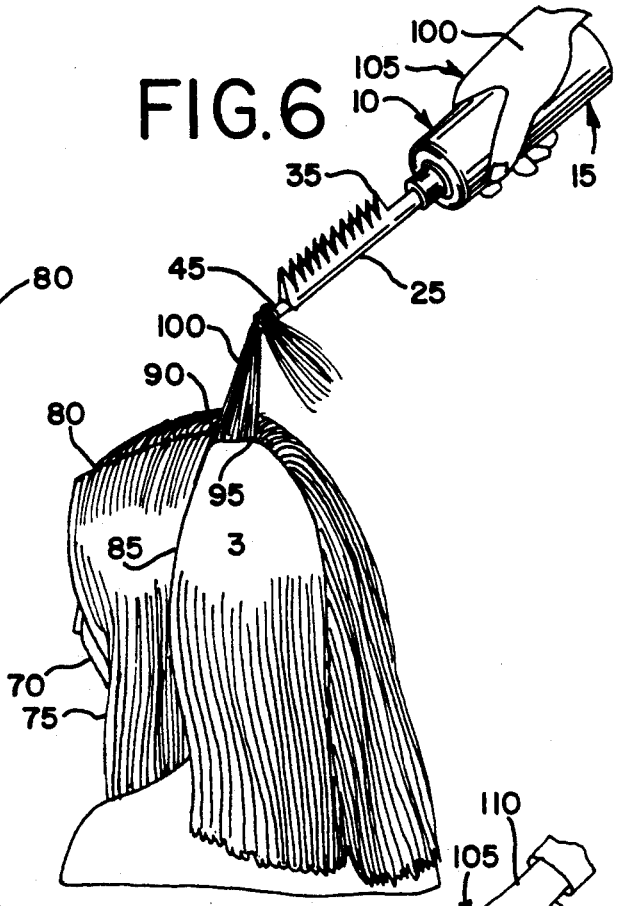
FIG. 6 is a perspective view of the preferred embodiment of the invention of FIG. 1 in use with hair and the surrounding environment thereof.

FIG. 6 shows the invention 10 having comb 25 with teeth 35, held by an operator 105 in hand 110, having comb 25 at deformable bottle 15. The operator 105 is using the separator 45 of the invention 10 to separate a portion 100 of hair 75 from section 3 of human head 70 having base of hair 95. FIG. 6 also shows first section line 80 and second section line 85 having intersection point 90.

Figure 7:
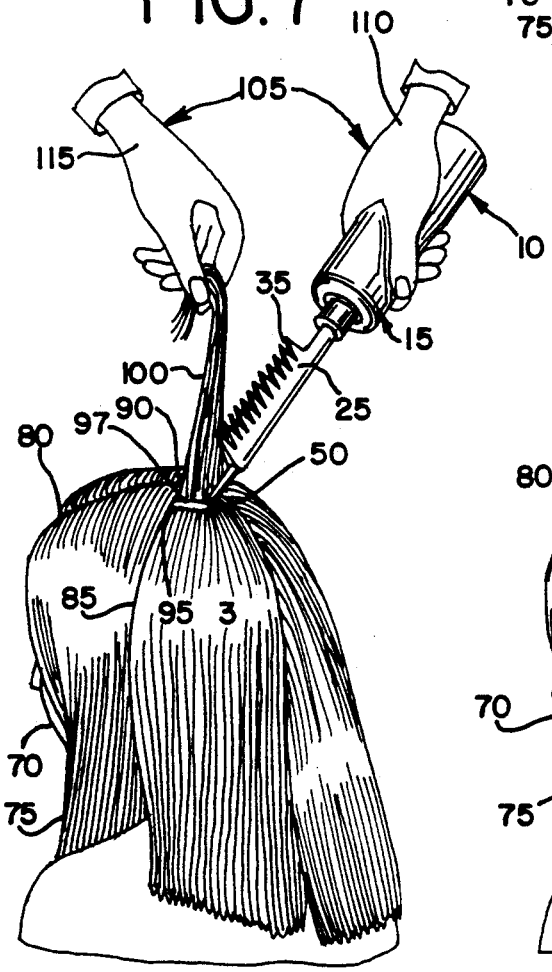
FIG. 7 is a perspective view of the preferred embodiment of the invention of FIG. 1 in use with hair and the surrounding environment thereof.

FIG. 7 shows the operator 105 applying hair chemical 97 from the invention 10 having comb 25 with teeth 35 out of fluid dispenser 50 onto hair 75 in section 3 of human head 70. FIG. 7 also shows first section line 80 and second section line 85 having intersection point 90. The operator 105 holds portion 100 of hair 75 in hand 115. Note that hand 110 is squeezing deformable bottle 15, which forces hair chemical 97 out of the invention 10 at fluid dispenser 50 onto base of hair 95. Hair chemical 97 can be hair dye, perm solution, or any other chemical that is applied to hair.

Figure 8:
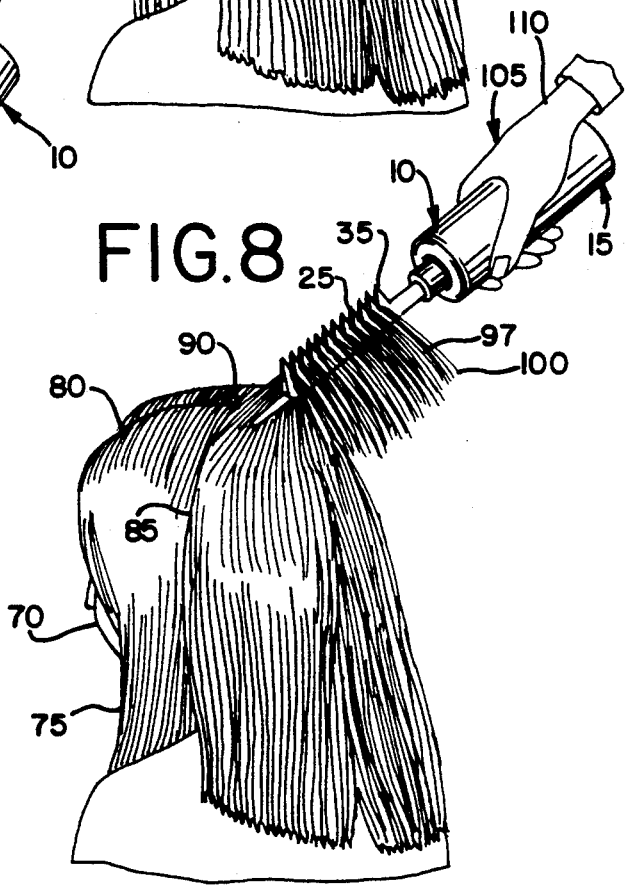
FIG. 8 is a perspective view of the preferred embodiment of the invention of FIG. 1 in use with hair and the surrounding environment thereof.

FIG. 8 shows the operator 105 holding the invention 10 at deformable bottle 15 combing the hair chemical 97 through hair portion 100 with the invention 10, hair 75 of human head 70, passing through teeth 35 of comb 25 and first section line 80 and second section line 85 having intersection point 90.

To operate the preferred embodiment of the invention 10, connector 20 is unscrewed from threaded opening 65 so that comb 25 can be removed from deformable bottle 15 as shown in FIG. 3. Deformable bottle 15 is then filled with the desired hair chemical 97. Connector 20 of comb 25 is screwed back onto threaded opening 65 of deformable bottle 15. The operator 105 then removes cap 55 from the fluid dispenser 50.

The operator 105 then parts hair 75 of human head 70 into four sections, 1, 2, 3 and 4 as shown in FIG. 5. The operator 105 can do this by using the invention 10 as he or she would any other comb. Then, as shown in FIG. 6, the operator 105 grasps the invention 10 in a hand 110, and with a gentle thrusting motion, uses the separator 45 to lift and separate a portion 100 of hair 75 near intersection point 90 on human head 70. Portion 100 of hair 75 is roughly at a diagonal to first section line 80 and second section line 85.

The operator 105 grasps hair portion 100 in his or her free hand 115. (See FIG. 7). The operator 105 then squeezes the deformable bottle 15 of the invention 10, thereby forcing hair chemical 97 out of the deformable bottle 15, through threaded opening 65, into the internal comb cavity 40 of comb 25, and ultimately through the separator 45 and out fluid dispenser 50 onto hair 75 at base of hair 95, as shown in FIG. 7.

The operator 105 then releases hair portion 100, and with repeated upward and downward strokes of comb 25 combs hair chemical 97 through hair portion 100, so that hair chemical 97 is evenly distributed through hair portion 100. The operator 105 then uses the separator 45 to separate another portion 100 of hair 75 at a point below the previous application of hair chemical 97, and the method of applying is repeated until hair chemical 97 is distributed evenly throughout the entire section 3. When one section, such as section 3, has been completely treated, the process is repeated on any remaining sections, until the entire head 70 of hair 75 has been treated with the hair chemical 97. The invention 10 as thus described therefore combines three separate instruments, comb, applicator, and hair separator into one simple unit, which can apply chemicals to hair with a few simple movements by an operator, making the application process simpler, quicker, cleaner, and ultimately safer for the operator and the operator's client.

In the alternate embodiment 210 of the invention, the method of applying hair chemical 97 is substantially the same as that for the preferred embodiment 10, except that the hair chemical 97 is dispensed from dispensing holes 250 on the spine 230 of comb 225 rather than from fluid dispenser 50. Instead of applying hair chemical 97 at the base of hair 95, the operator 105 applies hair chemical 97 directly along the full length of raised portion of hair 100. The operator 105, by merely twisting hand 110 then reverses comb 225 and combs the applied hair chemical 97 through raised hair portion 100 as shown in FIG. 8.

The foregoing specification describes only the preferred embodiment and the alternate embodiment of the invention as shown. Other embodiments may be articulated as well. The terms and expressions therefore serve only to describe the invention by example only and not to limit the invention. It is expected that others will perceive differences which while differing from the foregoing, do not depart from the spirit and scope of the invention herein described and claimed.

What I claim is:

1. A device for dispensing and applying chemicals into hair comprising:

means for combing chemicals through hair, having first and second ends, said coming means having an internal flow cavity extending from said first to said second end;

means for containing the chemicals, said containing means disposed on and in fluid communication with said internal flow cavity at said first end of said combing means;

means for separating hair, said means for separating hair having a free distal end, said separating hair means being disposed on said second end of said combing means; and means for dispensing the chemicals onto the hair, said dispensing means being at said distal end of said hair separating means, said dispensing means being in fluid communication with said internal flow cavity; said means for combing, said means for containing, said means for separating hair and said means for dispensing all being in axial alignment.

2. The invention of claim 1, wherein the dispensing means is disposed on said second end of said combing means.

3. The invention of claim 1, wherein said combing means has a spine, said spine having a top side and a bottom side, said bottom side having a plurality of teeth extending perpendicularly therefrom.

4. The invention of claim 1, wherein said containing means has a threaded opening, and said combing means has a connector sized to screwably engage said threaded opening.

5. The invention of claim 1, wherein the containing means is a deformable bottle.

6. A device for dispensing and applying chemicals into hair, comprising:

means for combing chemical through hair, having first and second ends, said combing means having an internal flow cavity extending from said first to said second end;

means for containing the chemicals, said containing means disposed on and in fluid communication with said internal flow cavity at said first end of said combing means;

means for separating hair disposed on said second end of said combing means; and means for dispensing the chemicals on the hair, said dispensing means in fluid communication with said internal flow cavity;

said combing means has a spine, said spine having a top side and a bottom side, said bottom side having a plurality of teeth extending perpendicularly therefrom;

said dispensing means consists of a plurality of holes disposed on an opposite side from said means for combing and adjacent of said means for combing, said holes being located along said spine, said holes being in fluid communication with the internal flow cavity of said combing means;

said means for combing, said means for containing, said means for separating hair and said means fir dispensing all being in axial alignment.

7. A device for dispensing and applying chemicals into hair, comprising:

means for combing chemicals through hair, having first and second ends, said combing means having an internal flow cavity extending form said first to said second end, said combing means having a spine, said spine having a top side and a bottom side, said bottom side having a plurality of teeth extending perpendicularly therefrom;

means for containing the chemicals, said containing means disposed on and in fluid communication with said internal flow cavity at said first end of said combing means, said containing means having a threaded orifice, and said combing means has a connector sized to screwably engage said threaded orifice;

means for separating hair, said means for separating hair having a free distal end, said separating hair means being disposed on said second end of said combing means; and means for dispensing the chemicals onto the hair, said dispensing means being at said distal end of said hair separating means, said dispensing means being in fluid communication with said internal flow cavity; said means for combing, said means for containing, said means for separating hair and said means for dispensing all being in axial alignment.

8. The invention of claim 7, wherein the dispensing means is disposed on said second end of said combing means.

9. The invention of claim 7, wherein the containing means is a deformable bottle.

10. A device for dispensing and applying chemicals into hair, comprising:

means for combing chemicals through hair, having first and second ends, said combing means having an internal flow cavity extending from said first to said second end, said combing means having a spine, said spine having a top side and a bottom side, said bottom side having a plurality of teeth extending perpendicularly therefrom;

means for containing the chemicals, said containing means disposed on and in fluid communication with said internal flow cavity at said first end of said combing means, said containing means having a threaded orifice, and said combing means has a connector sized to screwably engage said threaded orifice;

means for separating hair disposed on said second end of said combing means; and means for dispensing the chemicals onto the hair, said dispensing means in fluid communication with said internal flow cavity; said dispensing means consists of a plurality of holes disposed on an opposite side from said means for combing and adjacent to said means for combing, said holes being located along said spine, said holes being in fluid communication with the internal flow cavity of said combing means.

said means for combing, said means for containing, said means for separating hair and said means for dispensing all being in axial alignment.

11. A method for dispensing and applying chemicals to hair by an operator, using a device having a comb, hair separator, dispenser and deformable bottle, all combined into a single unit, comprising the steps of:

separating the hair into at least one section;

using a hair separator to separate a portion of hair form one said section;

grasping said hair portion by the operator;

separating the hair into four sections, said sections defined by a first section line and a second section line, said first section line substantially perpendicular to said second section line, said first and second section lines intersecting at an intersection point;

applying hair chemical to the hair from the dispenser;

twisting the invention so the comb is positioned under said hair portion; and combing the hair chemical through said hair portion with the comb, so the hair chemical is evenly distributed throughout the hair portion.

12. The method of claim 11, wherein the operator repeats the method until the hair chemical is distributed through the entire head of hair.

13. The method of claim 12, wherein the operator squeezes the deformable bottle to dispense the hair chemical from the dispenser.

14. The method of claim 11, wherein the operator dispenses the chemical to a base portion of the hair.

15. The method of claim 14, wherein the operator repeats the method until the hair chemical is distributed through the entire head of hair.

16. The method of claim 15, wherein the operator squeezes the deformable bottle to dispense the hair chemical from the dispenser.

17. The method of claim 11, wherein the operator squeezes the deformable bottle to dispense the hair chemical from the dispenser.

18. The method of claim 14, wherein the operator squeezes the deformable bottle to dispense the hair chemical from the dispenser.

* * * * *